US008572989B2

(12) United States Patent
Son et al.

(10) Patent No.: US 8,572,989 B2
(45) Date of Patent: Nov. 5, 2013

(54) AVATAR KIMCHI REFRIGERATOR

(75) Inventors: Ku-Young Son, Busan (KR); Eun-Jeong Kim, Changwon-shi (KR); Eun-Young Park, Ulsan (KR)

(73) Assignee: LG Electronics Inc., Seoul (KR)

( * ) Notice: Subject to any disclaimer, the term of this patent is extended or adjusted under 35 U.S.C. 154(b) by 955 days.

(21) Appl. No.: 11/359,433

(22) Filed: Feb. 23, 2006

(65) Prior Publication Data

US 2007/0039333 A1 Feb. 22, 2007

(30) Foreign Application Priority Data

Aug. 18, 2005 (KR) ..... 10-2005-0075771

(51) Int. Cl.
*G01K 13/00* (2006.01)

(52) U.S. Cl.
USPC ..... 62/129; 62/126; 236/94

(58) Field of Classification Search
USPC ..... 62/129, 126; 236/94; 165/26
See application file for complete search history.

(56) References Cited

U.S. PATENT DOCUMENTS

| | | | | |
|---|---|---|---|---|
| 2004/0216472 | A1* | 11/2004 | Cho | 62/126 |
| 2005/0086600 | A1* | 4/2005 | Black et al. | 715/706 |
| 2006/0043087 | A1* | 3/2006 | Gagas et al. | 219/391 |

FOREIGN PATENT DOCUMENTS

| | | | | |
|---|---|---|---|---|
| JP | 2000-329450 | | | 11/2000 |
| JP | 2002-139271 | | | 5/2002 |
| JP | 2003202180 | A | * | 7/2003 |
| JP | 2004276731 | A | * | 10/2004 |
| KR | 2001003960 | | * | 1/2001 |
| KR | 10-2004-003889 | | | 1/2004 |

OTHER PUBLICATIONS

Korean Office Action for Application 10-2005-0075771 dated Nov. 23, 2011.

English language Translation of Korean Office Action for Application 10-2005-0075771 dated Nov. 23, 2011.

* cited by examiner

*Primary Examiner* — Frantz Jules
*Assistant Examiner* — Azim Abdur Rahim
(74) *Attorney, Agent, or Firm* — KED & Associates LLP

(57) ABSTRACT

A Kimchi refrigerator is provided for storing and fermenting foods, such as Kimchi, soy, or bean paste at a low temperature. The Kimchi refrigerator displays a set special mode with a corresponding avatar, or displays various information of a special function of the set special mode, such as operation information and power information with corresponding avatars. As a result, a user can easily recognize each special mode.

20 Claims, 4 Drawing Sheets

AVATAR KIMCHI REFRIGERATOR

BACKGROUND OF THE INVENTION

1. Field of the Invention

The present invention relates to a Kimchi refrigerator for storing and fermenting foods such as Kimchi or soy and bean paste at a low temperature, and more particularly, to an avatar Kimchi refrigerator which can display a set special mode or various information of the special mode with an avatar in each special mode.

2. Description of Related Art

In general, a Kimchi refrigerator is a freezing apparatus which can control a ripening degree of Kimchi in a storage space at an appropriate temperature, and store the ripened Kimchi at a low temperature for an extended period of time.

Various kinds of Kimchi refrigerators are used by structures and functions. Normally, the Kimchi refrigerators are classified into a drawer type Kimchi refrigerator in which a storage space for storing Kimchi or other foods is slidably connected to a front surface of a main body, and a lid type Kimchi refrigerator (hereinafter, referred to as 'Kimchi refrigerator') in which a storage space for freezing or refrigerating Kimchi or other foods is formed in a main body and a lid is installed on the top surface of the main body to be opened or closed. When newly-prepared Kimchi is put into the Kimchi refrigerator, a heater is operated to ripen Kimchi at an appropriate temperature. After Kimchi is ripened, constitutional elements of a freezing cycle (compressor, condenser, expansion valve and evaporator) are operated to circulate refrigerants. Therefore, Kimchi is stored at a low temperature to prevent quality change.

The Kimchi refrigerator has a normal storage mode for storing foods such as Kimchi, vegetables and rice at a low temperature by freely controlling a temperature inside the refrigerator, and special modes having special functions, such as a rapid drop mode for rapidly cooling and storing foods at a low temperature, and a ferment mode for fermenting Kimchi or soy and bean paste at an appropriate temperature.

Accordingly, the Kimchi refrigerator can switch the storage mode into the special modes such as the rapid drop mode and the ferment mode. However, as compared with the storage mode, the compressor is operated at a high speed or the heater is used to increase electricity consumption. The user needs detailed information including the operation state or electricity consumption in the special modes.

SUMMARY OF THE INVENTION

The present invention is achieved to solve the above problems. An object of the present invention is to provide an avatar Kimchi refrigerator which can display a special mode for rapidly cooling or fermenting foods with an avatar.

Another object of the present invention is to provide an avatar Kimchi refrigerator which can display various information such as operation information and power information with avatars in a special mode for rapidly cooling or fermenting foods.

In order to achieve the above-described objects of the invention, there is provided an avatar Kimchi refrigerator, including: a main body having a storage space for storing foods; a door installed on the main body to be opened or closed; an input means installed on the main body or door, for setting a special mode for storing the foods by a special function; a control means installed to be connected to the input means, for setting temperature variations by time according to the special mode set by the input means, and controlling the temperature inside the storage space of the main body according to the temperature variations by time; and a display means adjacently installed to the input means to be connected to the control means, for displaying the set special mode and the corresponding avatar.

Preferably, the control means obtains operation information of the special function in the set special mode, and displays the operation information on the display means with the corresponding avatar. More preferably, the operation information obtained by the control means includes temperature variations by time in the storage space and operation time.

Preferably, the control means obtains power information of the special function in the set special mode, and displays the power information on the display means with the corresponding avatar. More preferably, the power information obtained by the control means includes power consumption and power rate.

Preferably, the special mode set by the input means includes a rapid drop mode for rapidly cooling and storing the foods at a low temperature, and a ferment mode for fermenting the foods. More preferably, the control means includes help for explaining various functions of the special modes, and displays the corresponding help on the display means in each special mode.

According to another aspect of the invention, there is provided an avatar Kimchi refrigerator, including: a main body having a storage space for storing foods; a door installed on the main body to be opened or closed; an input means installed on the main body or door, for setting a special mode for storing the foods by a special function; a control means installed to be connected to the input means, for setting temperature variations by time according to the special mode set by the input means, controlling the temperature inside the storage space of the main body according to the temperature variations by time, and obtaining various information of the special function in the set special mode; and a display means adjacently installed to the input means to be connected to the control means, for displaying various information of the special function of the set special mode with the corresponding avatars.

Preferably, the information obtained by the control means includes operation information and power information of the special function of the set special mode. More preferably, the operation information obtained by the control means includes temperature variations by time in the storage space and operation time, and the power information obtained by the control means includes power consumption and power rate.

Preferably, the special mode set by the input means includes a rapid drop mode for rapidly cooling and storing the foods at a low temperature, and a ferment mode for fermenting the foods. More preferably, the control means includes help for explaining various functions of the special modes, and displays the corresponding help on the display means in each special mode.

DESCRIPTION OF DRAWINGS

The present invention will become better understood with reference to the accompanying drawings which are given only by way of illustration and thus are not limitative of the present invention, wherein.

DETAILED DESCRIPTION

An avatar Kimchi refrigerator in accordance with the present invention will now be described in detail with reference to the accompanying drawings.

Figure 1A:
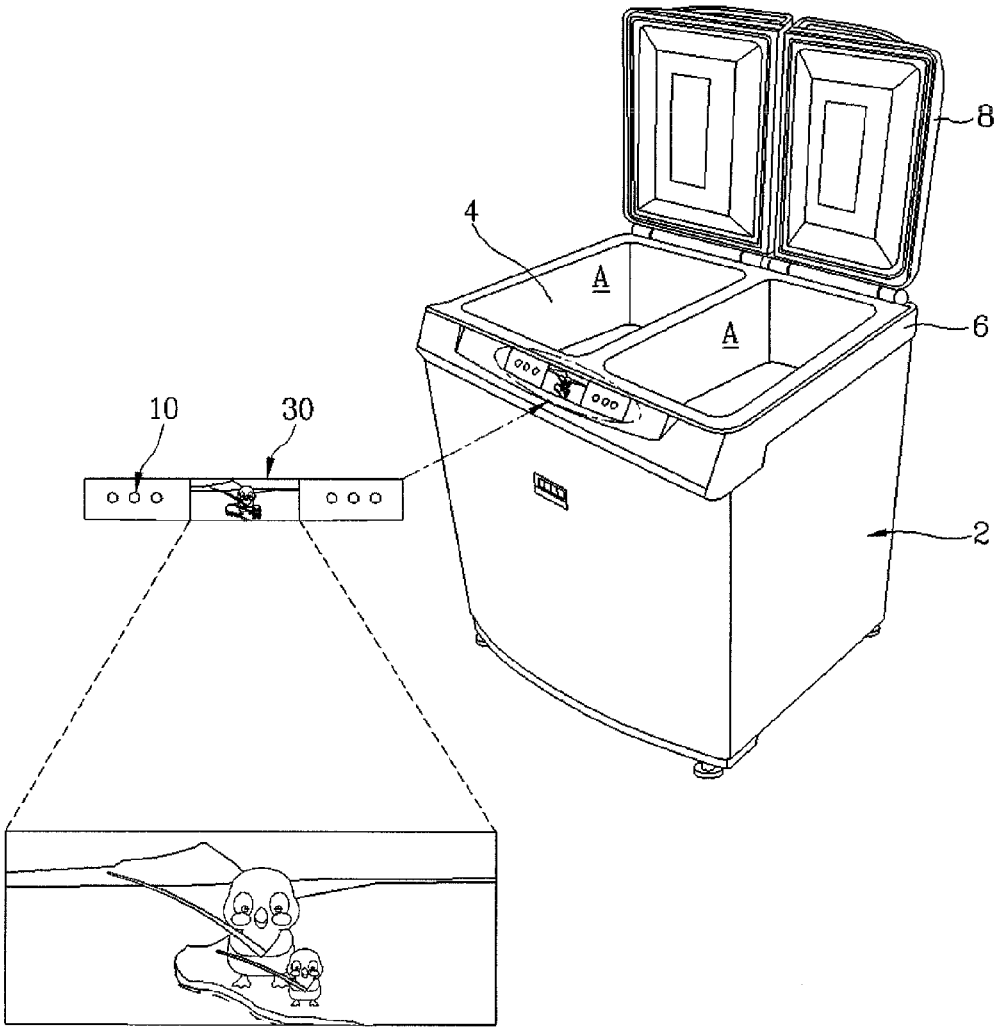
FIG. 1A is a perspective view illustrating an avatar Kimchi refrigerator in accordance with the present invention.
Figure 1B:
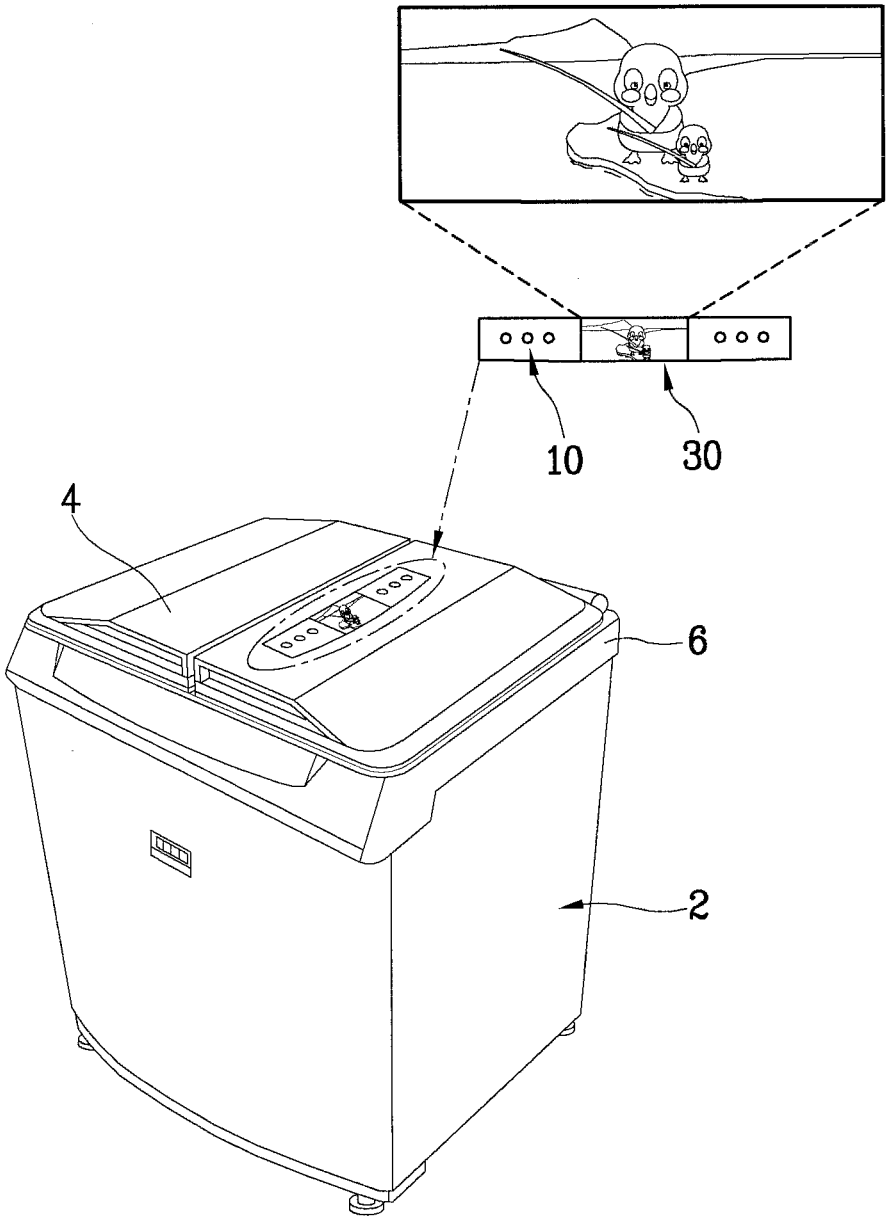
FIG. 1B is another perspective view illustrating the avatar Kimchi refrigerator in accordance with the present invention.
Figure 2:
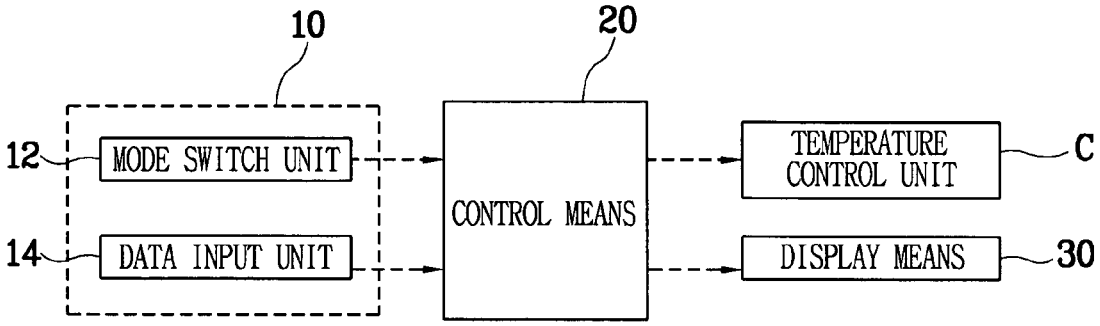
FIG. 2 is a block diagram illustrating a control device of the avatar Kimchi refrigerator in accordance with the present invention.

Referring to FIGS. 1A, 1B, and 2, in the avatar Kimchi refrigerator, an inner casing 4 having a storage space A for storing foods such as Kimchi or soy and bean paste is installed in a main body 2 having its top surface opened, and a heater (not shown) and constitutional elements of a freezing cycle (not shown) are installed in the space between the main body 2 and the inner casing 4 to maintain the storage space A at an appropriate temperature. An input means 10 installed on the front surface of the main body 2 sets a special mode for performing a special function such as a rapid drop, mode or a ferment mode, and inputs corresponding set data. A control means 20 connected to the input means 10 controls the temperature inside the storage space A according to the set mode and the set data. A display means 30 adjacently installed to the input means 10 to be connected to the control means 20 displays operation information and power information with avatars in the special mode, so that the user can recognize various information in the special mode.

A top cover 6 having two inlets/outlets is installed on the top surface of the main body 2, so that the user can put the foods such as Kimchi into the storage space A. Two doors 8 for covering the inlets/outlets of the top cover 6 are hinge-coupled side by side.

The heater and the freezing cycle are built in the main body 2 to maintain the storage space A at an appropriate temperature. The heater is an electric heater, and the freezing cycle includes a compressor, a condenser, an expansion valve and an evaporator for refrigerant circulation. The heater and the evaporator of the freezing cycle are formed in a tube shape to be wound around the storage space A, thereby composing a temperature control unit C for controlling the temperature inside the storage space A.

The operations of the heater and the evaporator are controlled by the control means 20. The heat generation of the heater and the heat exchange of the evaporator are controlled to adjust the temperature inside the storage space A.

The input means 10 includes a mode switch unit 12 for switching the storage mode, the rapid drop mode and the ferment mode, and a data input unit 14 for inputting set data in each mode. The input means 10 is installed at the upper portion of the front surface of the main body 2, so that the user can easily operate the input means 10.

The mode switch unit 10 sets one of the storage mode, the rapid drop mode and the ferment mode. The storage mode maintains an optimum storage state by storing foods such as Kimchi at a low temperature, the rapid drop mode reaches the lowest temperature within a short time by rapidly cooling the foods, and the ferment mode maintains an appropriate ferment state by storing Kimchi or soy and bean paste according to a temperature varied by time.

The storage mode is a normal mode for storing foods at a predetermined temperature, and the rapid drop mode and the ferment mode are special modes for performing special functions. In addition to the rapid drop mode and the ferment mode, various functions can be added to the special modes.

Generally, the data input unit 14 inputs set data including various kinds of foods, a set temperature and a set time in the special modes such as the rapid drop mode and the ferment mode rather than the normal mode such as the storage mode. The data input unit 14 selectively inputs the set data according to an input menu displayed on the display means 30 in each special mode.

The mode switch unit 12 and the data input unit 14 can be comprised of input buttons pressed by the finger of the user for receiving a ferment command according to an electric signal, contact buttons displayed on the touch screen type display means 30 and pressed by static electricity by finger contacts of the user for receiving a ferment command, or mikes for analyzing audio information and receiving a ferment command.

The control means 20 explains the special functions of each special mode and includes help for the set data input items in each special mode. When each special mode is set by the mode switch unit 12, the corresponding help is displayed on the display means 30.

The control means 20 controls the operations of the constitutional elements including the compressor and the heater, and also controls the heat generation and heat exchange of the temperature control unit C. Especially, the control means 20 performs the special function such as rapid cooling or ferment by controlling the operation of the temperature control unit C according to the set data inputted by the data input unit 14 in each special mode. At the same time, the control means 20 displays various operation information and power information on the display means 30 with avatars in each special mode.

Here, the control means 20 measures the temperature inside the storage space A and counts the operation time in the set special mode. Therefore, the control means 20 can obtain and store the operation information such as the temperature variations by time in the storage space A and the operation time in the set special mode.

Furthermore, the control means 20 calculates power consumed by the constitutional elements including the compressor and the heater to maintain the temperature inside the storage space A at the set temperature in the set special mode. Accordingly, the control means 20 can obtain and store power information such as power consumption and power rate in the set special mode.

The operation of the display means 30 adjacent to the input means 10 is controlled by the control means 20. The display means 30 displays the help for the special mode set by the mode switch unit 12, or displays various operation information and power information with avatars in each special mode.

Normally, the display means 30 is an LCD window, but can be a touch screen for displaying the mode switch unit 12 and the data input unit 14.

Figure 3:
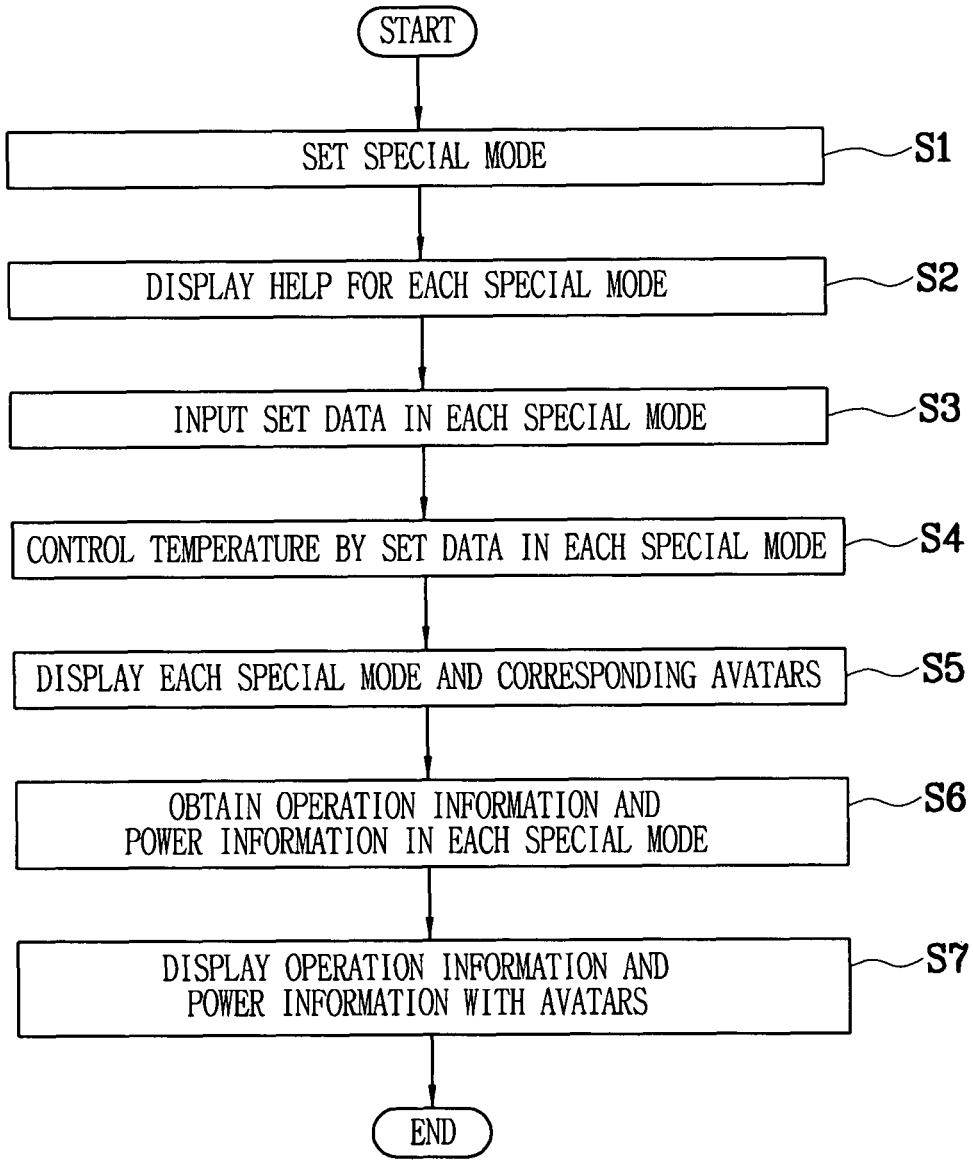
FIG. 3 is a flowchart showing the operation state of the avatar Kimchi refrigerator in accordance with the present invention.

The operation of the avatar Kimchi refrigerator in accordance with the present invention will now be described with reference to FIG. 3.

In the first step, when the special mode is set, the help for the special mode is displayed (S1 and S2).

The user can switch the normal mode such as the storage mode for storing foods at a low temperature into the special mode such as the rapid drop mode for rapidly cooling the foods in a short time or the ferment mode for fermenting Kimchi or soy and bean paste by using the mode switch unit 12. The mode switch unit 12 can be formed in various types, so that the user can directly press the mode switch unit 12 or transmit audio signals to the mode switch unit 12.

When the special mode switch signal is transmitted from the mode switch unit 12 to the control means 20, the control means 20 sets each special mode, explains the special functions of each special mode, and displays the help for the set data input items on the display means 30.

Preferably, the control means 20 directly displays explanations of the special functions on the display means 30, but displays explanations of the set data input items on the display means 30 by selection of the user.

In the second step, the set data are inputted in each special mode according to the help displayed in the first step, and the temperature is controlled according to the inputted data (S3 and S4).

For example, when the rapid drop mode is selected, the set temperature is inputted as the set data by the data input unit 14. The storage space A is cooled in a short time to have the set temperature inputted to the control means 20. In detail, the cooling operation is rapidly performed by increasing the heat exchange of the evaporator by operating the compressor at a high speed.

On the other hand, when the ferment mode is selected, a kind and degree of ferment are inputted as the set data by the data input unit 14. The storage space A is cooled or heat-insulated according to temperature variations by time on the basis of the kind and degree of ferment inputted to the control means 20. In detail, the ferment operation is performed by adjusting the heat exchange of the evaporator and the heat generation of the heater by controlling the operations of the compressor and the heater.

The set data inputted in each special mode can include the set temperature, the set time, the kind of ferment and the degree of ferment. As a result, the special functions are carried out by controlling the temperature inside the storage space A by time.

In the third step, the operation information and the power information are obtained during the special modes of the second step, and displayed with avatars (S5, S6 and S7).

In each special mode, the control means 20 displays the avatars corresponding to the special modes on the display means 30. For example, a trembling penguin can be displayed in the rapid drop mode, or a penguin warming the Kimchi refrigerator with a bonfire can be displayed in the ferment mode.

During the set special mode, the control means 20 obtains the operation information such as the temperature variations by time in the storage space A and the operation time or the power information such as the power consumption and the power rate, and displays the operation information or the power information on the display means 30 with the corresponding avatar.

For example, in the rapid drop mode, the compressor must be rotated at a high speed to rapidly cool the storage space A in a shot time, which increases the power consumption and the power rate. The control means 20 displays the power information such as the power consumption and the power rate on the display means 30, so that the user can recognize the power information and maintain, change or stop the operation.

In the ferment mode, the temperature inside the storage space A is varied by time. The control means 20 displays the operation information such as the temperature variations by time and the operation time on the display means 30, so that the user can recognize the operation information and maintain, change or stop the operation.

The operation information and the power information are displayed on the display means 30 with the corresponding avatars in the form of characters including numbers or graphs, so that the user can easily recognize the information. For example, the operation information can be displayed with a running penguin, and the power information can be displayed with a penguin getting a shock by lightening.

The lid type Kimchi refrigerator in which the door is installed on the main body to be opened or closed has been explained in detail on the basis of the preferred embodiments and accompanying drawings. However, the present invention can be applied to the general refrigerators including the side by side type refrigerator as well as the drawer type Kimchi refrigerator. Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A method of using an avatar Kimchi refrigerator having a plurality of special modes, wherein each of the plurality of special modes stores food according to special functions that are different from each other, and wherein each of the plurality of special modes has a corresponding avatar's distinct dynamic image associated therewith, the avatar Kimchi refrigerator comprising:

a main body having a storage space formed therein;

a door installed on the main body that opens and closes the main body;

an input device installed on the main body or the door, the input device being configured to receive an input and set one of the plurality of special modes based on the received input;

a controller connected to the input device, wherein the controller sets temperature variations by time according to the special mode set by the input device, and controls a temperature inside the storage space of the main body according to the temperature variations by time; and a display connected to the controller, wherein the display simultaneously displays the set special mode and the corresponding avatar's distinct dynamic image for implementing a user's easy recognition of the set special mode, during a period while the refrigerator performs the set special mode.

2. The method of using the avatar Kimchi refrigerator of claim 1, wherein the controller obtains operation information of the special functions of the set special mode, and displays the operation information on the display with the corresponding avatar.

3. The method of using the avatar Kimchi refrigerator of claim 2, wherein the operation information obtained by the controller comprises the temperature variations by time in the storage space and operation time.

4. The method of using the avatar Kimchi refrigerator of claim 1, wherein the controller obtains power information of the special functions of the set special mode, and displays the power information on the display with the corresponding avatar.

5. The method of using the avatar Kimchi refrigerator of claim 4, wherein the power information obtained by the controller comprises power consumption and power rate.

6. The method of using the avatar Kimchi refrigerator of claim 1, wherein the special mode set by the input device comprises a rapid drop mode for rapidly cooling and storing the food at a low temperature, and a ferment mode for fermenting the food.

7. The method of using the avatar Kimchi refrigerator of claim 6, wherein the controller includes help information for explaining the special functions of the plurality of special modes, and displays the corresponding help information on the display in each of the plurality of special modes.

8. A method of using an avatar Kimchi refrigerator having a plurality of special modes, wherein each of the plurality of special modes stores food according to special functions that are different from each other, and wherein each of the plurality of special modes has a corresponding avatar's distinct dynamic image associated therewith, the avatar Kimchi refrigerator comprising:

a main body having a storage space formed therein;

a door installed on the main body that opens and closes the main body;

an input device installed on the main body or the door, the input device being configured to receive an input and set one of the plurality of special modes based on the received input;

a controller connected to the input device, wherein the controller sets temperature variations by time according to the special mode set by the input device, controls a temperature inside the storage space of the main body according to the temperature variations by time, and obtains various information of the special functions of the set special mode; and a display connected to the controller, wherein the display simultaneously displays various information of the special functions of the set special mode with the avatar's distinct dynamic image corresponding to the set special mode for implementing a user's easy recognition of the set special mode, during a period while the refrigerator performs the set special mode.

9. The method of using the avatar Kimchi refrigerator of claim 8, wherein the information obtained by the controller comprises operation information and power information of the special functions of the set special mode.

10. The method of using the avatar Kimchi refrigerator of claim 9, wherein the operation information obtained by the controller comprises the temperature variations by time in the storage space and operation time.

11. The method of using the avatar Kimchi refrigerator of claim 9, wherein the power information obtained by the controller comprises power consumption and power rate.

12. The method of using the avatar Kimchi refrigerator of claim 8, wherein the special mode set by the input device comprises a rapid drop mode for rapidly cooling and storing the food at a low temperature, and a ferment mode for fermenting the food.

13. The method of using the avatar Kimchi refrigerator of claim 12, wherein the controller includes help information for explaining the special functions of the plurality of special modes, and displays the corresponding help information on the display in each of the plurality of special modes.

14. The method of using the avatar Kimchi refrigerator of claim 1, wherein the controller is installed in the main body.

15. The method of using the avatar Kimchi refrigerator of claim 1, wherein the display is installed adjacent to the input device.

16. The method of using the avatar Kimchi refrigerator of claim 1, wherein the input device comprises a mode switching device configured to receive input of and set one of the plurality of special modes and a data input device configured to receive input of data corresponding to the plurality of special modes.

17. The method of using the avatar Kimchi refrigerator of claim 16, wherein the mode switching device and the data input device of the input device comprise one of a plurality of push buttons and a plurality of touch contacts displayed on a touch screen LCD.

18. The method of using the avatar Kimchi refrigerator of claim 8, wherein the controller is installed in the main body.

19. The method of using the avatar Kimchi refrigerator of claim 8, wherein the input device comprises a mode switching device configured to receive input and set one of the plurality of special modes and a data input device configured to receive input of data corresponding to the plurality of special modes.

20. The method of using the avatar Kimchi refrigerator of claim 8, wherein the display is installed adjacent to the input device.

* * * * *